US012044233B2

(12) United States Patent
Brevini et al.

(10) Patent No.: US 12,044,233 B2
(45) Date of Patent: Jul. 23, 2024

(54) AXIAL PISTON PUMP WITH INCLINED PLATE

(71) Applicant: MIXTRON S.R.L., Reggio Emilia (IT)

(72) Inventors: Stefano Brevini, Reggio Emilia (IT); Renato Brevini, Reggio Emilia (IT)

(73) Assignee: MIXTRON S.R.L., Reggio Emilia (IT)

( * ) Notice: Subject to any disclaimer, the term of this patent is extended or adjusted under 35 U.S.C. 154(b) by 106 days.

(21) Appl. No.: 17/784,850

(22) PCT Filed: Dec. 1, 2020

(86) PCT No.: PCT/IB2020/061307

§ 371 (c)(1),
(2) Date: Jun. 13, 2022

(87) PCT Pub. No.: WO2021/123982

PCT Pub. Date: Jun. 24, 2021

(65) Prior Publication Data

US 2023/0003216 A1 Jan. 5, 2023

(30) Foreign Application Priority Data

Dec. 17, 2019 (IT) ..... 102019000024241

(51) Int. Cl.
*F04D 1/14* (2006.01)
*F04B 1/14* (2020.01)
(Continued)

(52) U.S. Cl.
CPC ..... *F04B 53/1087* (2013.01); *F04B 1/14* (2013.01); *F04B 1/143* (2013.01); *F04B 1/18* (2013.01); *F04B 1/2042* (2013.01); *F04B 53/16* (2013.01)

(58) Field of Classification Search
CPC ..... F04B 1/14–188; F04B 53/16
See application file for complete search history.

(56) References Cited

U.S. PATENT DOCUMENTS

2005/0053478 A1 3/2005 Sakikawa

FOREIGN PATENT DOCUMENTS

CN 108757363 A * 11/2018 ..... F04B 1/122
DE 29611935 U1 9/1996
(Continued)

*Primary Examiner* — Thomas Fink
(74) *Attorney, Agent, or Firm* — Browdy and Neimark, PLLC

(57) ABSTRACT

This describes an axial piston pump (1, 1') with inclined plate for pumping a liquid comprising: a head (20) in which there are at least partially made a plurality of cylinders (25*a*, 25*b*, 25*c*, 25*d*, 25*e*) in a number greater than three, with central axes parallel to each other, a plurality of pistons (75) each one sliding in a respective cylinder (25*a*, 25*b*, 25*c*, 25*d*, 25*e*) of the plurality of cylinders (25*a*, 25*b*, 25*c*, 25*d*, 25*e*) for pumping liquid, a plurality of suction valves (115), each one housed in a respective housing seat made in the head (20), a plurality of suction channels (155*a*, 155*b*, 155*c*, 155*d*, 155*e*) made in the head, one for each suction valve (115), each of which, independently from the other suction channels, places a housing seat of a suction valve (115) in fluid communication with the corresponding cylinder (25*a*, 25*b*, 25*c*, 25*d*, 25*e*), a plurality of delivery valves (120), each one housed in a respective housing seat made in the head (20), a plurality of delivery channels (160*a*, 160*b*, 160*c*, 160*d*, 160*e*) made in the head, one for each delivery valve (120), each of which, independently from the other delivery channels, places a cylinder (25*a*, 25*b*, 25*c*, 25*d*, 25*e*) in fluid communication with the housing seat of the corresponding delivery valve (120).

10 Claims, 6 Drawing Sheets

(51) Int. Cl.

| | |
|---|---|
| ***F04B 1/143*** | (2020.01) |
| ***F04B 1/18*** | (2020.01) |
| ***F04B 1/2042*** | (2020.01) |
| ***F04B 53/10*** | (2006.01) |
| ***F04B 53/16*** | (2006.01) |

(56) References Cited

FOREIGN PATENT DOCUMENTS

| | | | |
|---|---|---|---|
| GB | 1320242 | A | 6/1973 |
| WO | 2008003705 | A2 | 1/2008 |

* cited by examiner

AXIAL PISTON PUMP WITH INCLINED PLATE

TECHNICAL FIELD

The present invention relates to an axial piston pump, in particular an axial piston pump for high pressures and usable with low viscosity fluids.

PRIOR ART

Axial piston pumps with inclined plate generally comprise a head in which there is at least partially a plurality of cylinders arranged in parallel to each other and in each of which a piston slides to pump a liquid. Said cylinders are connected to a liquid source to pump through a suction channel, usually comprising a primary duct and a plurality of branch ducts that place the primary duct in fluid communication with the cylinders.

Axial pumps with inclined plate for high pressures with three pistons are known, which on one hand are of relatively simple design and construction, particularly as regards the construction and design of the suction channels, and on the other hand have significant fluctuations in flow rate during operation.

An object of the present invention is to make available an axial piston pump with reduced delivery flow rate fluctuation which is at the same time of compact and efficient construction in fluid-dynamic terms, all within a rational and affordable solution. Such object is achieved by the features of the invention indicated in the independent claim. The dependent claims outline preferred and/or particularly advantageous aspects of the invention.

DISCLOSURE OF THE INVENTION

In particular, the invention makes available an axial piston pump for pumping liquid comprising:

- a head in which there is at least partially a plurality of cylinders in a number greater than three, with central parallel axes,
- a plurality of pistons that each slide within a respective cylinder of the plurality of cylinders for the pumping of the liquid,
- a plurality of suction valves, each housed in a respective housing seat made in the head,
- a plurality of suction channels made in the head, one for each suction valve, each of which, independently from the other suction channels, places a housing seat of a suction valve in fluid communication with the corresponding cylinder,
- a plurality of delivery valves, each housed in a respective housing seat made in the head,
- a plurality of delivery channels made in the head, one for each delivery valve, which extend along the respective central axes], each of which, independently from the other delivery channels, places a cylinder in fluid communication with the housing seat of a corresponding delivery valve.

This solution makes available an axial piston pump with reduced delivery flow rate fluctuation which is robust and compact and particularly efficient in fluid-dynamic terms.

According to an aspect of the invention, each suction channel may be transversal to the central axe of the respective cylinder and each delivery channel may be transversal to the central axes of the respective cylinder.

In this way the axial compactness of the pump is improved.

In order to further improve said advantage, according to another aspect of the invention, in which the suction channels may be made entirely in a portion of the head between a first plane and a second plane perpendicular to the central axes of the cylinders, and the delivery channels may all be made in a portion of the head between the second plane and a third plane, the third plane of which is perpendicular to the central axes of the cylinders and positioned to the side of the second plane on a side opposite the first plane.

According to another aspect of the invention, at least a portion of a suction channel is aligned along a direction parallel to the central axes of the cylinders to at least a portion of a delivery channel.

In this way the axial compactness of the pump is improved.

Another aspect of the invention envisages that all the delivery channels can extend along their respective central axes which lie on a same plane, separate from a lying plane of respective central axes along which the suction channels extend.

This characteristic helps to improve the axial compactness of the pump.

According to another aspect of the invention, the lying plane of the central axes of the delivery channels and the lying plane of the central axes of the suction channels are perpendicular to the central axes of the cylinders.

This characteristics described makes it possible to further improve the axial compactness of the pump in relation to the characteristics described above.

According to another aspect of the invention, the housing seats of the suction valves may be aligned along a same transversal axis, for example perpendicular, to the central axes of the cylinders.

This characteristic improves the compactness of the pump and simplifies access to the valves for maintenance purposes, as this arrangement does not require that the machine on which the pump is installed to have particularly large compartments for access to the pump itself.

For example, the housing seats of the delivery valves may also be aligned along a same transversal axis, for example perpendicular, to the central axes of the cylinders.

Preferably the housing seats of the delivery valves are positioned on a diagonally opposite side of the pump from the housing seats of the suction valves.

An aspect of the invention envisages that the pump may comprise a crankcase, inside which there is at least partially housed a rotating plate adapted to act on the pistons, and a plurality of through holes made in the head and adapted to receive the respective tightening screws configured to fix the head to the crankcase, and in which at least one of either a suction channel or a delivery channel crosses a portion of the head positioned between two adjacent through holes.

According to another aspect of the invention, the pump may comprise five suction valves, five respective housing seats and five respective suction channels, of which a first suction channel has a central axis lying on a centreline plane of the pump parallel to the axes of the cylinders, a second suction channel and a third suction channel are placed on opposite sides of the first suction channel and are parallel to the centreline plane, for example they have central axes parallel to the centreline plane, and a fourth suction channel and a fifth suction channel positioned the first on the side of the second suction channel and the second on the side of the third suction channel and arranged on an inclined plane, for example with central axes inclined in relation to the centreline plane.

This characteristic makes it possible to improve the radial compactness of the head of the pump. It is specified that radial refers to the radial direction in relation to the central axes of the cylinders.

Another aspect of the invention envisages that at least of either a delivery channel or a suction channel may comprise a first rectilinear stretch and a second rectilinear stretch inclined in relation to the other, each of said stretches being positioned between two different pairs of adjacent through holes for receiving the tightening screws.

This characteristic helps to improve the radial compactness of the pump.

Preferably the first rectilinear stretch and the second rectilinear stretch are part of a respective different through hole which extends from a side surface of the head towards the inside of the head.

In this way the channel, which in the embodiment shown is a delivery channel, but it is not excluded that in an alternative embodiment not shown this could be a suction channel, is easy to create, thus obtaining a compact pump the creation of which is at the same time relatively quick.

BRIEF DESCRIPTION OF THE DRAWINGS

Further features and advantages of the invention will be more apparent after reading the following description provided by way of a non-limiting example, with the aid of the figures shown in the accompanying drawings.

BEST MODE OF THE INVENTION

Figure 1:
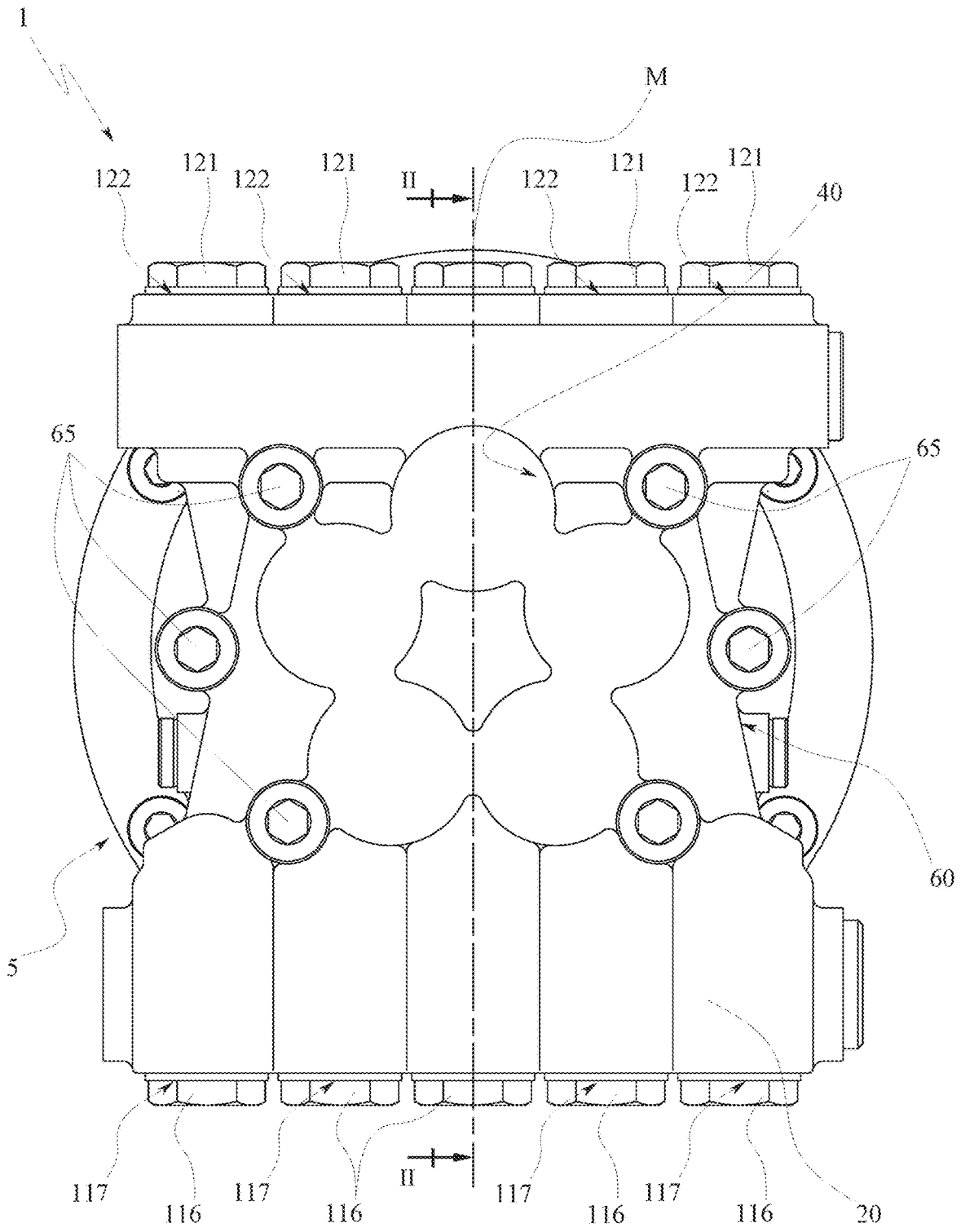
FIG. 1 is a front view of an axial piston pump according to the invention.
Figure 2:
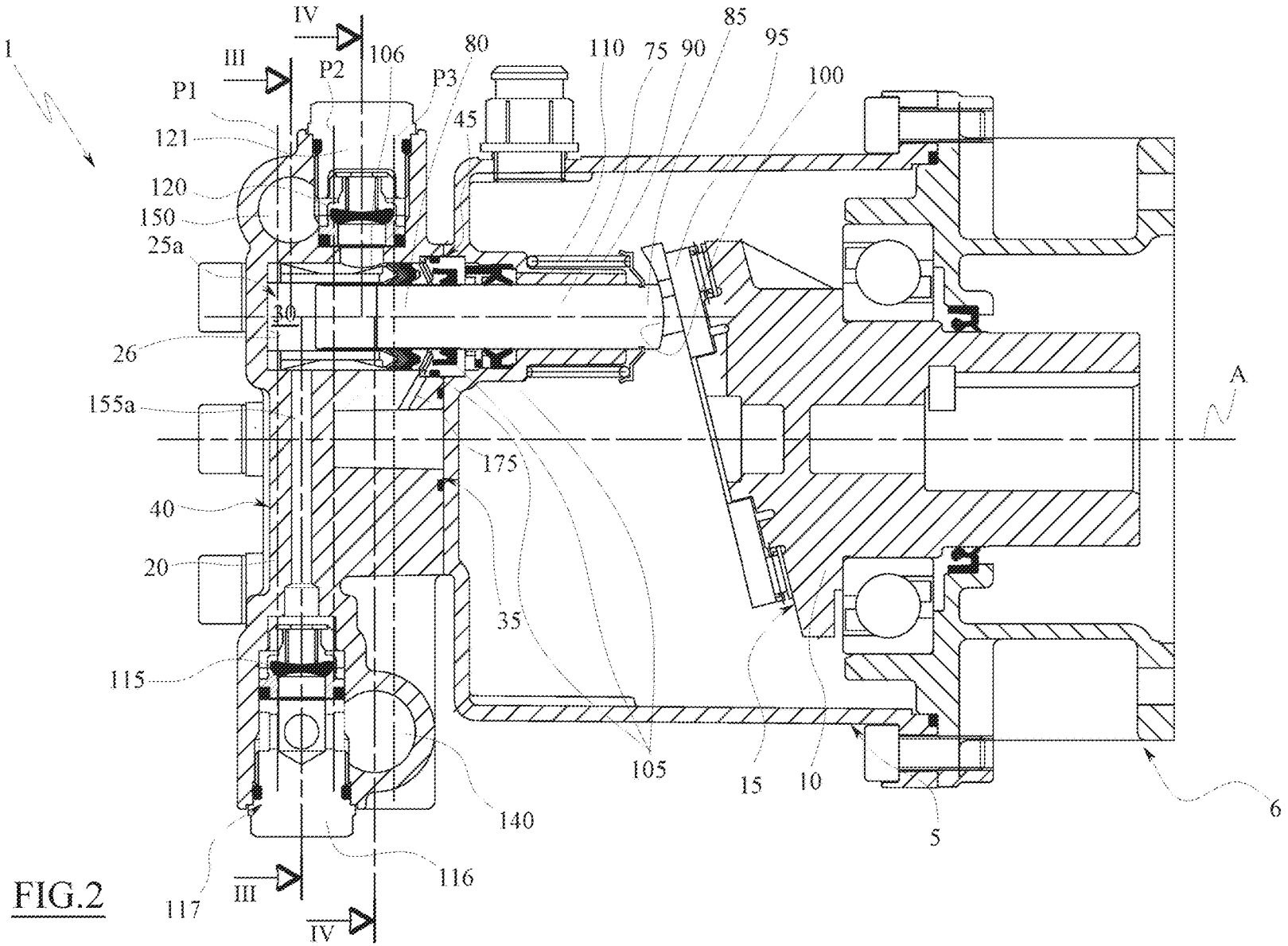
FIG. 2 is a section view of the axial piston pump in FIG. 1, taken along the plane II-II.
Figure 3:
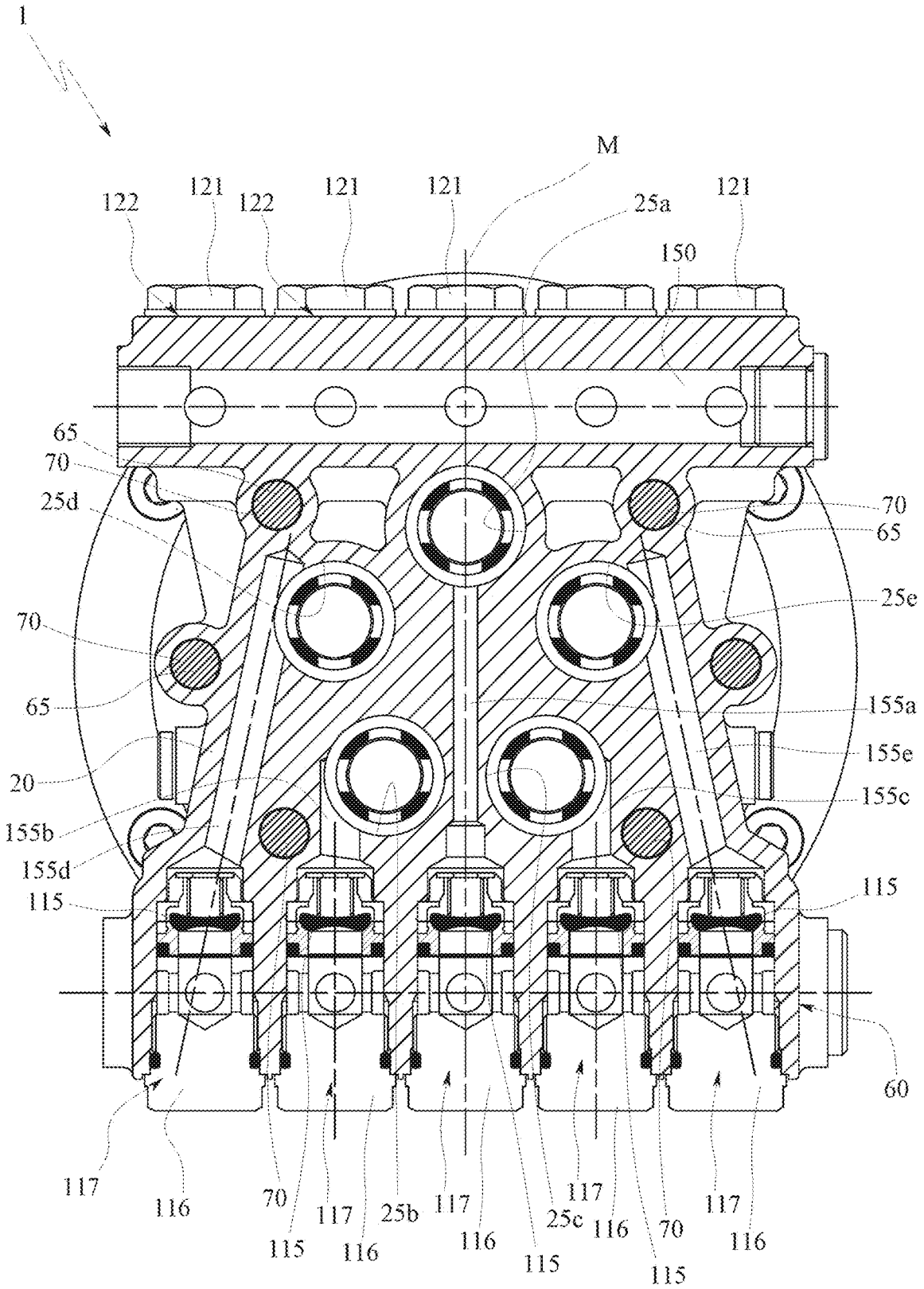
FIG. 3 is a section view according to the plane III-III of FIG. 2.
Figure 4:
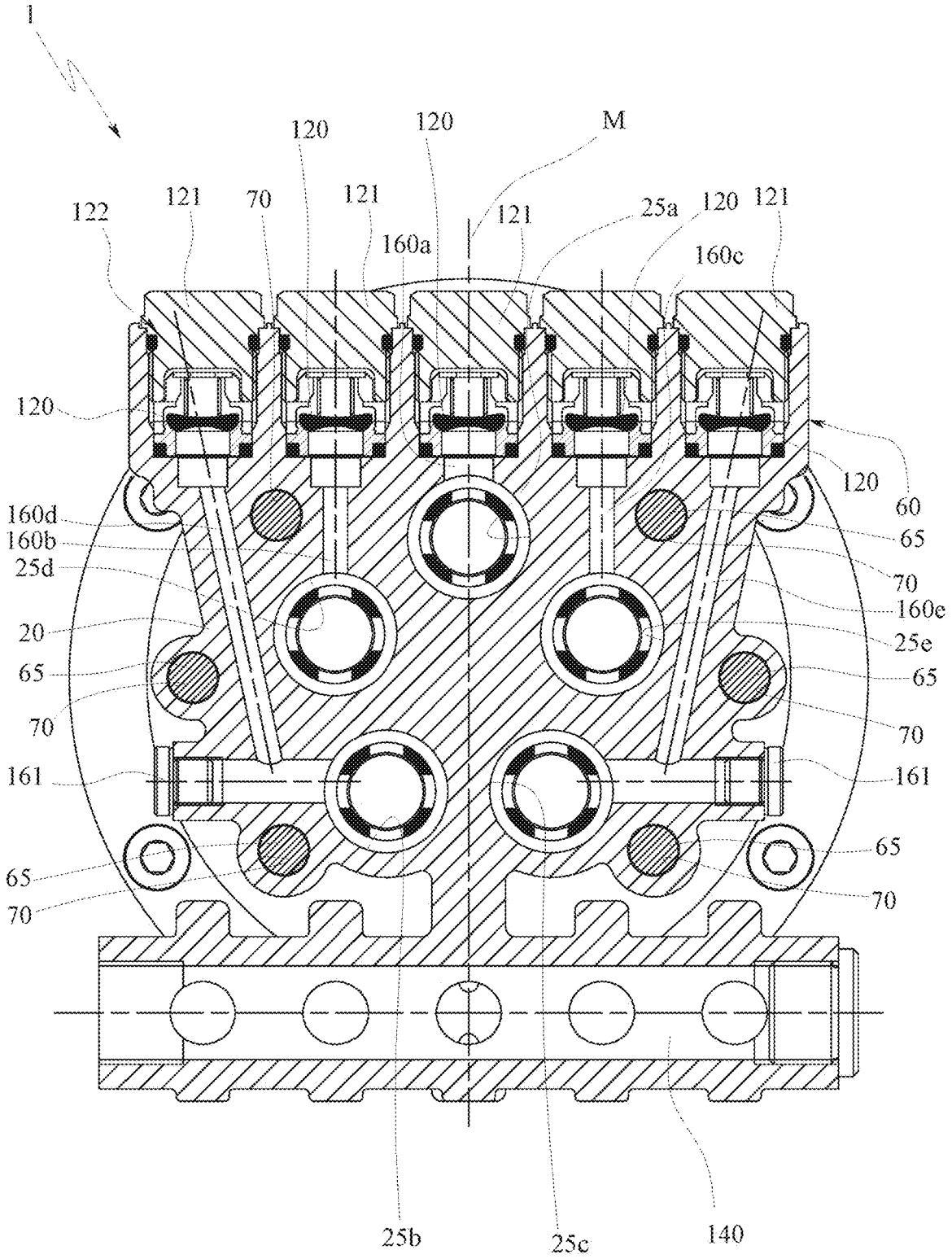
FIG. 4 is a section view according to the plane IV-IV of FIG. 2.

With particular reference to these figures, 1, 1' indicates overall an axial piston pump for high pressures, preferably suited for pumping liquids with low viscosity, for example water.

For example, the axial piston pump 1, 1' is of the type fitted with a fixed inclination rotating plate, as better described below. Furthermore it is of the type fitted with automatic valves for controlling the pumping flow.

The axial piston pump 1, 1' may comprise a crankcase 5, a rotating inclined plate 10, adapted to receive a rotating motion from a crankshaft external to the axial piston pump 1, 1', and for example a fixing flange 6 fixed to a motor equipped with the said crankshaft.

The inclined plate 10 is housed in the crankcase 5, it is rotatably associated to it on a pivot axis A, and for example comprises a flat annular surface 15 lying on an inclined plane in relation to the pivot axis A. In particular, the inclined plate is rotatably associated by a bearing to the flange 6, which is bolted to the crankcase 5.

The axial piston pump 1, 1' comprises a head 20 fixed to the crankcase 5, or fixed without residual degrees of freedom to the crankcase 5, in which there is a plurality of cylinders, that is cylindrical holes, each one adapted to contain respective liquid pumping chambers 30.

The head 20 can be made in a unitary body, that can be obtained by processing a single body obtained from the solidification of a single cast or injection of material into a mould. The cylinders of the plurality of cylinders are more than three, that is at least four, preferably there are five, and are arranged with their respective central axes parallel to each other.

For example, the cylinders are arranged radially along a common axis, in relation to which the axes of the single central cylinders are parallel. Furthermore they are placed at an equal distance from each other and at the same distance to the common axis. In other words, the cylinders, that is the central axes of the cylinders, are arranged at equidistant angles to each other along an imaginary circumference centred on the common axis. In the shown embodiment, the common axis of the cylinders is coaxial to a central axis of the head. For example, said common axis is also coaxial to the pivot axis A.

Again in the shown embodiment, in which there are five cylinders, the central axes of the cylinders pass through the vertices of an imaginary regular pentagon lying on a perpendicular plane to the central axes of the cylinders themselves.

Preferably the cylinders are made as blind holes, each one with an opening facing the base frame.

In particular, the head may comprise a first face 35, which is transversal to the central axes of the cylinders, and is proximal to, preferably in contact with, the crankcase 5, and is for example flat, and an opposite second face 40, which is transversal to the central axes of the cylinders and is distal to the crankcase 5. The cylinders, that is cylindrical holes, cross only the first face 40 making the respective opening in it.

The cylindrical holes can for example have a cross-section that is not constant along their axial extension. This characteristic allows the creation of shoulder surfaces.

It is specified that the second face 40 and the first face 35 are connected by a tubular shaped side surface 60 of the head.

Each cylinder comprises a bottom wall 26 lying on a transversal plane, for example perpendicular, to the axis of the cylinder itself. For example, the bottom wall 26 is separated from the second face of the head by a non-null distance.

The cylinders preferably all have the same diameter.

In the pump shown, the plurality of cylinders comprises a first cylinder 25*a* the central axis of which lies on a centreline plane M of the pump parallel to the central axes of all the cylinders. In particular this centreline plane divides the first cylinder itself into two specular halves.

The plurality of cylinders then comprises a second cylinder 25*b*, a third cylinder 25*c*, a fourth cylinder 25*d* and a fifth cylinder 25*e*, in which the second and the third cylinder are specular to the fourth and fifth cylinder in relation to said centreline plane M. Furthermore, the second cylinder and the fifth cylinder are closer to the first cylinder and are further from the centreline plane compared to the third and fourth cylinders.

The axial piston pump 1, 1' comprises a plurality of pistons 75 each adapted to slide in a respective cylinder 25*a*, 25*b*, 25*c*, 25*d*, 25*e*, driven by the inclined plate 10 to pump the fluid.

In particular, following the rotation of the inclined plate 10, the pistons 75 are made to slide along the central axes of the respective cylinders 25*a*, 25*b*, 25*c*, 25*d*, 25*e* between a top dead centre, in which the volume of the pumping chamber 30 is minimal, and a bottom dead centre, in which the volume of the pumping chamber is maximum.

In the shown embodiment, each piston 75 has a first axial end 80 which partially delimits the pumping chamber and an opposite second axial end 85 which protrudes from the cylinder 25*a*, 25*b*, 25*c*, 25*d*, 25*e* inside the crankcase 5 and, via a respective elastic element 90, is held in contact with an annular guide 95 which rests on the flat annular surface 15 of the inclined plate 10, for example by interposition of an axial roller bearing.

Each elastic element 90 has a first end connected to the crankcase 5 and a second end connected to the piston 75, for example near the second end 85.

The second axial end 85 may be rounded and convex in shape. In this case the annular guide 95 has a concave annular surface 100 adapted to house the second axial end and allows relative sliding between the annular guide and the second axial end 85. In particular, the concave annular surface 100 defines a profile, in a section plane containing the pivot axis, with a radius of curvature of between 1.5 and 1.7 times the diameter of the piston 75, preferably 1.6 times.

The axial piston pump 1, 1' comprises a plurality of annular gaskets 105 adapted to embrace and seal a respective piston 75, for example these annular gaskets being some housed in the crankcase 5 and others in the head 20, to prevent the fluid communication between the pumping chambers 30 and the crankcase 5.

Furthermore, the axial piston pump 1, 1' may comprise a plurality of guide cylinders 110, for example made in the crankcase 5, each one adapted to guide a respective piston 75 sliding along the central axis of the corresponding cylinder 25*a*, 25*b*, 25*c*, 25*d*, 25*e*.

These guide cylinders 110 are in communication with the respective first openings 45 in the head 20. In particular, the gaskets housed in the crankcase 5 are inserted in an annular cavity between the respective cylinder 25*a*, 25*b*, 25*c*, 25*d*, 25*e* and the corresponding guide cylinder 110.

The axial piston pump 1, 1' may comprise a axially hollow spacer 106 so that the piston can slide inside it, which at one axial end is in contact with the bottom wall 26 and at the opposite end is in contact with the annular gaskets 105. The spacer 106 also comprises radial openings used to allow the circulation of the suctioned and pumped liquid.

The pump 1, 1' comprises a plurality of tightening screws 65, for example in a number at least equal to the number of cylinders, preferably in a greater number than the number of cylinders, configured to fix the head 20 to the crankcase 5 and which are inserted in as many through holes 70 made in the head 20.

The through holes 70 are divided into just two groups of holes, these two groups being each positioned on opposite sides in relation to the centreline plane M and preferably the through holes 70 of each group are specular to the through holes of the other group in relation to the centreline plane M.

In the embodiment shown, the pump 1, 1' comprises six through holes and each group of through holes 70 comprises a pair of first holes placed at the same distance from the centreline plane M and a second hole placed at a greater distance than the first holes from the centreline plane M and interposed between a pair of planes perpendicular to the centreline plane and each one passing through a respective first hole.

The pump 1, 1' may comprise a suction valve 115 and a delivery valve 120 for each cylinder 25*a*, 25*b*, 25*c*, 25*d*, 25*e*, the valves of which are automatic and single-acting and allow the definition of the flow direction from and to the pumping chamber 30. In particular the suction valve 115 allows the flow only to the pumping chamber 30 and the delivery valve 120 allows the flow only from the pumping chamber 30.

It is specified that automatic valve refers to a valve configured to open automatically allowing fluid communication, between two environments between which it is interposed, when a pre-set difference between the pressures in both environments divided by the valve itself is reached. Specifically, automatic valves do not exploit electromechanical operating mechanisms but only differences in pressure.

Each suction valve 115 comprises an inlet mouth and an outlet mouth, which is in fluid communication with the pumping chamber, and each delivery valve 120 comprises an inlet mouth, which is in fluid communication with the pumping chamber, and an outlet mouth.

The pump 1, 1' comprises a respective housing seat for each suction valve 115 made directly in the head, for example made directly in the head as a hollow with an opening 117 that flows externally to the head and is closed by a suction cap 116 configured to maintain the respective suction valve 115 in position in its housing seat.

In the embodiment shown, the pump 1, 1' comprises five housing seats of respective suction valves of which a first housing seat which is divided in half by the centreline plane M (for example a central axis of the opening of the first housing seat lies on the centreline plane M), a second housing seat and a third housing seat positioned on opposite sides of the first housing seat specularly to the centreline plane M, and a fourth housing seat and a third housing seat positioned respectively to the side of the second housing seat and of the third housing seat specularly in relation to the centreline plane M.

The pump 1, 1' comprises a suction channel 140 for the distribution of the liquid to be pumped to the cylinders 25*a*, 25*b*, 25*c*, 25*d*, 25*e*. In particular, the suction channel 140 is in direct fluid communication with a portion of the housing seats of each suction valve 115 upstream of the suction valve 115 in relation to the flow direction of the fluid when the pump is in use. That is to say, the suction channel 140 is in direct fluid communication with the inlet mouth of each suction valve 115.

In the shown embodiment, the suction channel 140 is shaped as a cylindrical duct with a central axis perpendicular to a plane containing the central axis of a cylinder 25*a*, 25*b*, 25*c*, 25*d*, 25*e* of the plurality of cylinders 25*a*, 25*b*, 25*c*, 25*d*, 25*e*, for example perpendicular also to the centreline plane M of the pump.

The pump 1, 1' comprises removable fixing means of a pipe, external to the pump, which place said pipe in direct fluid communication with the suction channel 140. For example these means may comprise a rapid coupling/decoupling collar or a threaded and axially hollow connection body.

The pump 1, 1' comprises a housing seat for each delivery valve 120 made directly in the head, for example made directly in the head as a hollow with an opening 122 that flows externally to the head and is closed by a delivery cap 121 configured to maintain the respective delivery valve 120 in position in its housing seat.

The pump 1, 1' comprises a delivery channel 150 for collecting the pumped liquid, which is in direct fluid communication with the delivery valves 120, and is placed downstream to it in relation to the fluid direction when the pump is in use. For example, the delivery channel 150 is in direct fluid communication with the outlet mouth of each delivery valve 120.

In detail, the delivery channel 150 is in direct fluid communication with a portion of the housing seats of each delivery valve 120 downstream of the delivery valve 120 in relation to the flow direction of the fluid when the pump is in use.

In the shown embodiment, the delivery channel 150 is shaped as a cylindrical duct with a central axis perpendicular to a plane containing the central axis of a cylinder 25*a*, 25*b*, 25*c*, 25*d*, 25*e* of the plurality of cylinders 25*a*, 25*b*, 25*c*, 25*d*, 25*e*, for example perpendicular to the centreline plane M of the pump.

The pump 1, 1' comprises removable fixing means of a pipe, external to the pump, which places said pipe in direct fluid communication with the delivery channel 150. For example these means may comprise a rapid coupling/decoupling collar or a threaded and axially hollow connection body.

The pump 1, 1' comprises a plurality of suction channels made in the head, for example all made entirely in a portion of the head between a first plane P1 (imaginary) and a second plane P2 (imaginary) which intersect the head 20 and are perpendicular to the central axes of the cylinders. In the embodiment shown the first plane is closer to the second face 40 than the second plane.

There is one suction channel for each suction valve 115, that is one for each cylinder 25*a*, 25*b*, 25*c*, 25*d*, 25*e*. Each of said suction channels places the respective housing seat of the respective suction valve 115 in direct fluid communication with, for example, the corresponding cylinder. In particular, each suction channel places the housing seat of the suction valve in communication with the respective cylinder independently from the other suction channels. That is, the internal surface of each suction channel does not intersect the internal surface of any other suction channel and the pump has no secondary channel used to place in direct fluid communication portions of two different suction channels.

Specifically, via each suction channel, a portion of the housing seat of the respective suction valve lying downstream of the suction valve 115 in relation to the fluid flow direction when the pump is in use, is placed in direct fluid communication with the respective cylinder 25*a*, 25*b*, 25*c*, 25*d*, 25*e*.

In other words, by said suction channel, the outlet mouth of the suction valve 115 is in direct fluid communication only with the respective cylinder.

Furthermore, each suction channel places a single housing seat of a suction valve 115 in direct fluid communication only with a respective cylinder 25*a*, 25*b*, 25*c*, 25*d*, 25*e* of the plurality of cylinders.

Each suction channel is transversal to the central axis of the respective cylinder, for example it is perpendicular to the central axis of the respective cylinder 25*a*, 25*b*, 25*c*, 25*d*, 25*e*.

In particular each suction channel comprises at least a rectilinear cylindrical stretch, the central axis of which is transversal to the central axis of the respective cylinder, for example the central axis of which lies on a plane perpendicular to the central axes of the cylinders 25*a*, 25*b*, 25*c*, 25*d*, 25*e*.

For example, the rectilinear cylindrical stretches of each suction channel lie on a same plane perpendicular to the central axes of the cylinders.

Preferably, at least a suction channel is shaped as a rectilinear cylindrical channel, for example with a constant cross-section along its whole extension, which extends along a respective central axis directly from the respective housing seat of the delivery valve to directly intersect the respective cylinder 25*a*, 25*b*, 25*c*, 25*d*, 25*e*.

For example, the central axis of this cylindrical and rectilinear suction channel lies on a plane perpendicular to the central axes of the cylinders.

In particular, this suction channel is shaped as a rectilinear cylindrical hole that extends directly from the hollow of the housing seat of the respective suction valve to directly intersect the respective cylinder 25*a*, 25*b*, 25*c*, 25*d*, 25*e*.

In other words, said suction channel directly intersects an internal surface of said hollow and directly intersects an internal surface of said cylinder 25*a*, 25*b*, 25*c*, 25*d*, 25*e*.

In the embodiment shown all suction channels are shaped as rectilinear cylindrical channels with the characteristics described above of the channel shaped as a rectilinear cylindrical channel.

For example, all suction channels are arranged with the respective central axes on a same plane, which is for example perpendicular to the central axes of the cylinders.

Furthermore the suction channels are symmetrical in relation to the centreline plane M.

In the embodiment shown, the plurality of suction channels comprises five respective cylindrical and rectilinear suction channels, of which a first suction channel 155*a* has its own central axis lying on the centreline plane M, and a second suction channel 155*b* and a third suction channel 155*c* are placed on opposite sides of the first suction channel and are specular to said centreline plane M. For example the second and the third suction channel are parallel to the centreline plane M.

The five suction channels also comprise a fourth suction channel 155*d* and a fifth suction channel 155*e*, where the fourth suction channel is positioned to the side of the second suction channel 155*b*, further from centreline plane M than said second suction channel 155*b*, and fifth suction channel is positioned to the side of the third suction channel, further from the centreline plane M than the third suction channel. For example the fourth and the fifth suction channels are specular to the centreline plane M and are preferably inclined in relation to a said centreline plane M (that is the respective central axes are inclined in relation to the centreline plane M).

The first suction channel 155*a* places the first housing seat in direct fluid communication with the first cylinder 25*a*, the second suction channel 155*b* places the second housing seat in direct fluid communication with the second cylinder 25*b*, the third suction channel 155*c* places the third housing seat in direct fluid communication with the third cylinder 25*c*, the fourth suction channel 155*d* places the fourth housing seat in direct fluid communication with the fourth cylinder 25*d*, and the fifth suction channel 155*e* places the fifth housing seat in direct fluid communication with the fifth cylinder 25*e*.

At least a suction channel crosses a portion of the head between two adjacent through holes 70 and positioned on a same side in relation to the centreline plane M. That is at least a suction channel crosses a portion of the head between two through holes 70 of a single group of the plurality of the through holes.

In the embodiment shown, the fourth suction channel 155*d* crosses a portion of the head between two adjacent through holes 70 and positioned on a same side in relation to the centreline plane M, in particular between a first through hole of the pair of first holes and the second through hole, of a single group of the plurality of the through holes. The fifth suction channel 155*e* also crosses a portion of the head between two adjacent through holes 70 and positioned on a same side in relation to the centreline plane M, in particular between a first through hole of the pair of first holes and the second through hole, of a single group of the plurality of the through holes. The through holes through which the fifth suction channel 155*e* passes are part of the other group of through holes of the plurality of through holes.

The pump 1, 1' comprises a plurality of delivery channels made in the head, for example all made entirely in a portion of the head between a second plane P2 and a third plane P3 (imaginary) which liked plane P1 and plane P2 intersects the head and is perpendicular to the central axes of the cylinders. The third plane P3 is positioned on one side of the second plane opposite the first plane, for example it is closer to the first face 35 than the second plane.

The delivery channels are in fluid communication with the suction channels solely via the internal volume of the respective cylinder with which they are both in fluid communication.

There is one delivery channel for each delivery valve 120, that is one for each cylinder 25*a*, 25*b*, 25*c*, 25*d*, 25*e*. Each of said delivery channels places the respective housing seat of the respective delivery valve 120 in direct fluid communication with, for example, the corresponding cylinder. In particular, each delivery channel places the housing seat of the delivery valve in communication with the respective cylinder independently from the other delivery channels. That is, the internal surface of each delivery channel does not intersect the internal surface of any other delivery channel and the pump has no secondary channel used to place in direct fluid communication portions of two different delivery channel.

Specifically, via each delivery channel, a portion of the housing seat of the respective delivery valve lying upstream of the delivery valve 120 in relation to the fluid flow direction when the pump is in use, is placed in direct fluid communication with the respective cylinder 25*a*, 25*b*, 25*c*, 25*d*, 25*e*.

In other words, by said delivery channel, the inlet mouth of the delivery valve 120 is in direct fluid communication with the respective cylinder.

Furthermore, each delivery channel places a single housing seat of a delivery valve 120 in direct fluid communication only with a respective cylinder 25*a*, 25*b*, 25*c*, 25*d*, 25*e* of the plurality of cylinders.

Each delivery channel is transversal to the central axis of the respective cylinder, for example perpendicular to the central axis of the respective cylinder 25*a*, 25*b*, 25*c*, 25*d*, 25*e*.

In particular each delivery channel comprises at least a rectilinear cylindrical stretch, the central axis of which is transversal to the central axis of the respective cylinder, for example the central axis of which lies on a plane perpendicular to the central axes of the cylinders 25*a*, 25*b*, 25*c*, 25*d*, 25*e*.

For example, the rectilinear cylindrical stretches of each delivery channel lie on a same plane perpendicular to the central axes of the cylinders.

Preferably, at least a delivery channel is shaped as a rectilinear cylindrical channel, for example with a constant cross-section along its whole extension, which extends along a respective central axis directly from the respective housing seat of the delivery valve to directly intersect the respective cylinder 25*a*, 25*b*, 25*c*, 25*d*, 25*e*.

In other words, said rectilinear and cylindrical delivery channel directly intersects an internal surface of said hollow and directly intersects an internal surface of said cylinder 25*a*, 25*b*, 25*c*, 25*d*, 25*e*.

For example, the central axis of this cylindrical and rectilinear delivery channel lies on a plane perpendicular to the central axes of the cylinders.

Preferably, all delivery channels are arranged with the respective central axes on a same plane, which is for example perpendicular to the central axes of the cylinders and separate from the lying plane of the central axes of the delivery channels.

Furthermore the delivery channels are symmetrical in relation to the centreline plane M.

In the embodiment shown, the plurality of delivery channels comprises five respective delivery channels with central axes lying on a same plane, of which a first delivery channel 160*a* has its own central axis lying on the centreline plane M, and a second delivery channel 160*b* and a third delivery channel 160*c* are placed on opposite sides of the first delivery channel and are specular to said centreline plane M. For example the second and the third delivery channel are parallel to the centreline plane M.

The five delivery channels also comprise a fourth delivery channel 160*d* and a fifth delivery channel 160*e*, where the fourth delivery channel is positioned to the side of the second delivery channel 160*b*, further from centreline plane M than said second delivery channel 160*b*, and fifth delivery channel is positioned to the side of the third delivery channel, 160*c* further from the centreline plane M than the third delivery channel. For example the fourth and the fifth delivery channel are specular to the centreline plane M and are preferably inclined in relation to a said centreline plane M (that is the respective central axes are inclined in relation to the centreline plane M.

The first delivery channel 160*a* places the first housing seat in direct fluid communication with the first cylinder 25*a*, the second delivery channel 160*b* places the second housing seat in direct fluid communication with the fourth cylinder 25*d*, the third delivery channel 160*c* places the third housing seat in direct fluid communication with the fifth cylinder 25*e*, the fourth delivery channel 160*d* places the fourth housing seat in direct fluid communication with the second cylinder 25*b*, and the fifth delivery channel 160*e* places the fifth housing seat in direct fluid communication with the second cylinder 25*e*.

In the embodiment shown the first, the second and the third delivery channel are shaped as rectilinear cylindrical channels with the characteristics described above of the delivery channel shaped as a rectilinear cylindrical channel.

In particular, these first, second and third delivery channels are shaped each as a rectilinear cylindrical hole which extends through the head from the hollow of the housing seat of the respective delivery valve and directly intersects the respective cylinder 25*a*, 25*b*, 25*c*, 25*d*, 25*e*.

The fourth delivery channel 160*d* and the fifth delivery channel 160*e* each comprise two stretches, for example, only two rectilinear and cylindrical stretches which are directly adjacent, of which a first stretch which ends in the housing seat of the respective delivery valve and the second stretch which ends in the respective cylinder 25*d*, 25*e*, in which the central axis of the second stretch is coplanar and inclined in relation to the central axis of the first stretch.

Preferably the first stretch is made as a rectilinear cylindrical hole which extends from the hollow in the respective housing seat towards the inside of the head and the second stretch is made as a rectilinear cylindrical hole which crosses the head from the side surface 60 of the head, in which it makes an opening closed by a cap 161 of the pump 1, 1', to the respective cylinder intersecting the first stretch.

Of the delivery channels, at least one has a portion which is aligned along a direction parallel to the central axes of the cylinders to a portion of a suction channel. In the embodiment shown the fourth delivery channel 160*d* is equipped with a portion aligned along a direction parallel to the central axes of the cylinders to a portion of the fourth suction channel 155*d*. Furthermore, the fifth delivery channel 160*e* is equipped with a portion aligned along a direction parallel to the central axes of the cylinders to a portion of the fifth suction channel 155*e*.

At least one delivery channel crosses a portion of the head between two adjacent through holes 70 and positioned on a same side in relation to the centreline plane. That is, at least a delivery channel crosses a portion of the head between two through holes 70 of a single group of the plurality of the through holes.

In the embodiment shown, the fourth delivery channel 160*d* crosses a portion of the head between two adjacent through holes 70 and positioned on a same side in relation to the centreline plane M, in particular between a first through hole of the pair of first holes and the second through hole, of a single group of the plurality of the through holes. In the embodiment shown, both the first stretch and the second stretch of the fourth delivery channel cross respectively a space between two different pairs of adjacent through holes 70 and placed on a same side of the centreline plane M. For example, the first stretch crosses a portion of the head between a first through hole of the pair of first holes and the second through hole, of a single group of the plurality of the through holes, and the second stretch crosses a portion of the head between the other first through hole of the pair of first holes and the second through hole.

The fourth delivery channel 160*e* also crosses a portion of the head between two adjacent through holes 70 and positioned on a same side in relation to the centreline plane M, in particular between a first through hole of the pair of first holes and the second through hole, of a single group of the plurality of the through holes. The through holes through which the fifth delivery channel 160*e* passes are part of the other group of through holes of the plurality of through holes in relation to which the group of through holes through which the fourth delivery channel passes. For example, the first stretch of the fifth delivery channel crosses a portion of the head between a first through hole of the pair of first holes and the second through hole, of a single group of the plurality of the through holes, and the second stretch of the fifth delivery channel crosses a portion of the head between the other first through hole of the pair of first holes and the second through hole.

In an embodiment not shown, the delivery channels are all made a rectilinear cylinder channels, preferably substantially shaped and arranged like the delivery channels of the embodiment shown, with the obvious reversal of the housing seats of the suction valves with the housing seats of the delivery valves.

Furthermore, in this embodiment not shown, the suction channels are substantially shaped and arranged like the delivery channels of the embodiment shown, with the obvious reversal of the housing seats of the delivery valves with the housing seats of the suction valves.

In particular, in this embodiment not shown there are three suction channels, shaped as rectilinear cylindrical channels, and another two suction channels each have a first rectilinear cylindrical stretch and a second rectilinear cylindrical stretch, inclined in relation to the first stretch The housing seats of the suction valves 115 are aligned to each other along a direction perpendicular to the centreline plane M, and ad for example all have openings 117 facing the same direction, that is the central axes of the openings are all parallel to each other and lie on a same plane.

In the embodiment of the pump 1 shown in FIGS. 1-4, the lying plane of the central axes of the openings is perpendicular to the central axes of the cylinders.

Figure 5:
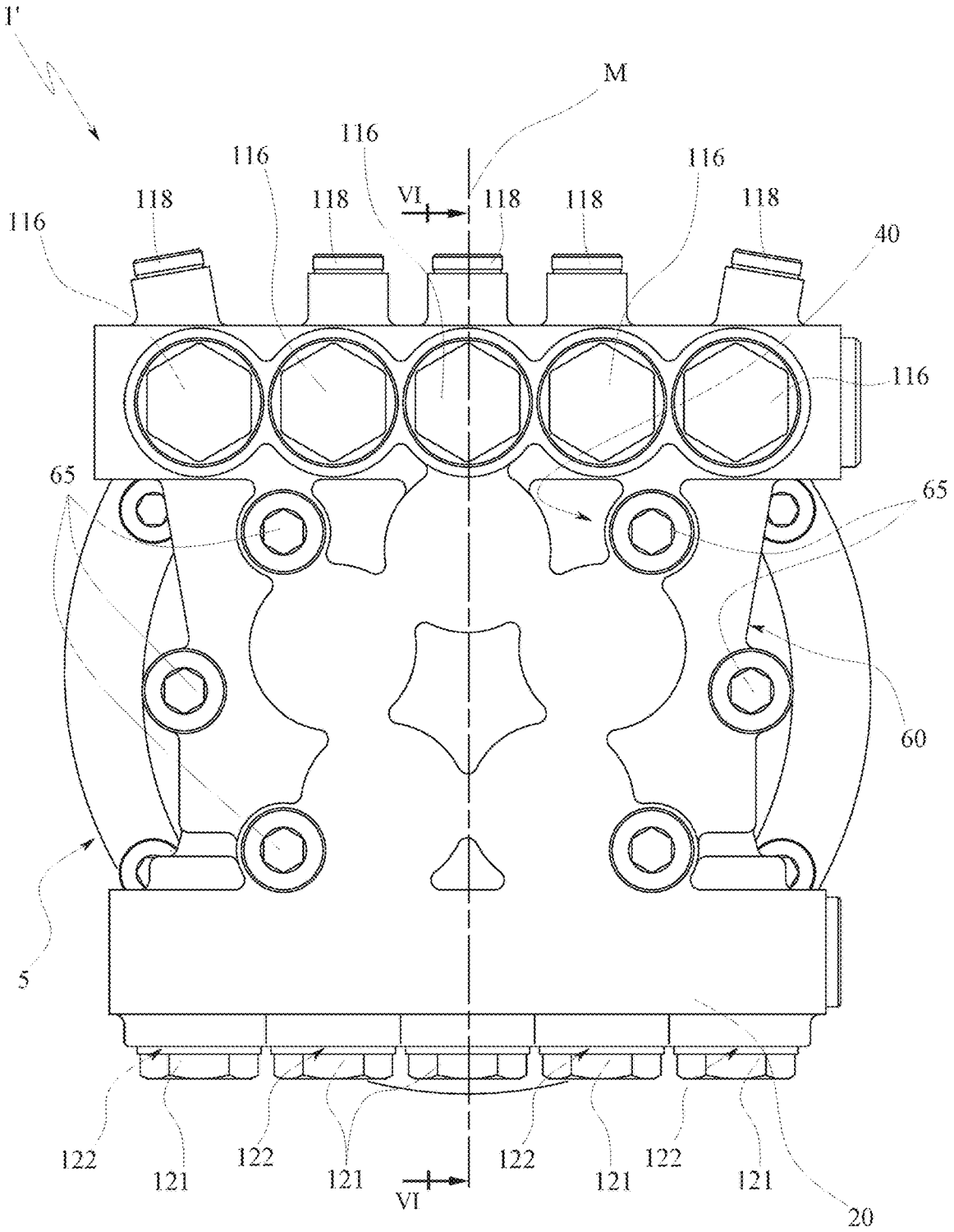
FIG. 5 is a front view of another embodiment of the axial piston pump according to the invention.
Figure 6:
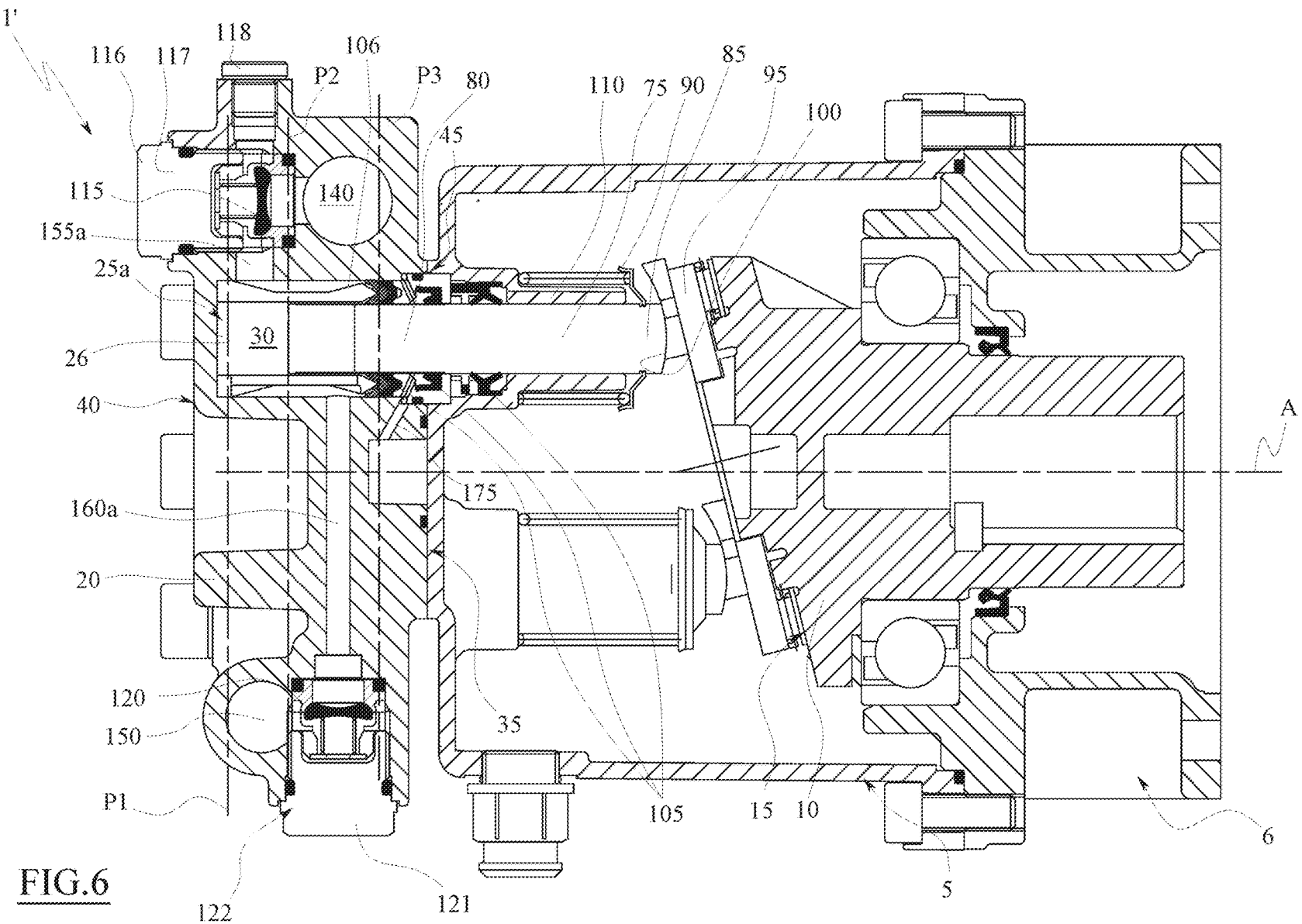
FIG. 6 is a section view of the axial piston pump in FIG. 5, taken along the plane VI-VI.

In the embodiment of the pump 1' shown in FIGS. 5-6 the central axes of the openings 117 lie on a same plane parallel to the central axes of the cylinders, for example also perpendicular to the centreline plane M.

In this embodiment, the suction channels of the pump 1' are shaped as cylindrical holes which extend from the side surface 60 of the head to the respective cylinder, intersecting the housing seat of the respective suction valve, and which make an opening in the side surface closed by a respective cap 118.

The housing seats of the delivery valves 160 are aligned to each other along a direction perpendicular to the centreline plane M, and ad for example all have openings 122 facing the same direction, that is the central axes of the openings are all parallel to each other and lie on a same plane, which is for example perpendicular to the central axes of the cylinders.

However, it is not excluded that in an alternative embodiment not shown, the central axes of the openings 122 may lie on a same plane parallel to the central axes of the cylinders, for example also perpendicular to the centreline plane M.

In both embodiments, the pump 1 may also comprise return ducts 175 which place the cylinders in direct fluid communication with the suction channel 140. In particular, each return duct 175 flows into a portion of the respective cylinder axially positioned between a pair of annular seal gaskets 105. This axial portion is placed near the crankcase 5.

In this way it is possible to directly take the liquid under pressure leaking from the annular gaskets present in the cylinder directly to the suction channel.

The operation of the pump according to the invention is as follows.

After the movement of the inclined rotating plate, in one or more cylinders at the same time, the movement of the respective piston towards a bottom dead centre generates a vacuum inside the pumping chamber, which in turn causes the respective delivery valve to close and the respective suction valve to open. Consequently, liquid is suctioned by the suction channel 140, from there directly enters the respective housing seat of the suction valve to then reach the corresponding pumping chamber 30 crossing the respective suction valve 115 and subsequently the respective suction channel. Having reached the bottom dead centre, the piston rises towards the top dead centre following the thrust of the inclined plate, generating an overpressure in the pumping chamber which closes the suction valve and opens the delivery valve. The fluid therefore flows through the respective delivery channel towards the delivery valve 120, through which it is collected in the housing seats of the delivery valve and subsequently in the delivery channels.

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. An axial piston pump with an inclined plate for pumping liquid comprising:

a head in which there is at least partially a plurality of cylinders in a number greater than three, with central parallel axes, a plurality of pistons that each slide within a respective cylinder of the plurality of cylinders for the pumping of the liquid, a plurality of suction valves, each housed in a respective housing seat made in the head, a plurality of suction channels made in the head, one for each suction valve, each of which, independently from the other suction channels, places a housing seat of a suction valve in fluid communication with the corresponding cylinder, a plurality of delivery valves, each housed in a respective housing seat made in the head, a plurality of delivery channels made in the head, one for each delivery valve, each of which, independently from the other delivery channels, places a cylinder in fluid communication with the housing seat of a corresponding delivery valve, wherein each suction channel is transversal to the central axis of the respective cylinder and each delivery channel is transversal to the central axis of the respective cylinder.

2. The axial piston pump according to claim 1, in which the suction channels are made entirely in a portion of the head between a first plane (P1) and a second plane (P2) perpendicular to the central axes of the cylinders and the delivery channels are all made in a portion of the head between the second plane (P2) and a third plane (P3), the third plane being perpendicular to the central axes of the cylinders and positioned to the side of the second plane on a side opposite the first plane.

3. The axial piston pump according to claim 2, in which at least a portion of a suction channel is aligned along a direction parallel to the central axes of the cylinders to at least a portion of a delivery channel.

4. The axial piston pump according to claim 2, in which all the delivery channels extend along respective central axes which lie on a same plane, separate from a lying plane of respective central axes along which the suction channels extend.

5. The axial piston pump according to claim 4, in which the lying plane of the central axes of the delivery channels and the lying plane of the central axes of the suction channels are perpendicular to the central axes of the cylinders.

6. The axial piston pump according to claim 1, in which the suction channels are symmetrical to each other in relation to a centreline plane (M) of the pump parallel to the axes of the cylinders.

7. The axial piston pump according to claim 6, comprising five suction valves, five respective housing seats and five respective suction channels, of which a first suction channel (155*a*) has a central axis lying on the centreline plane (M) of the pump, a second suction channel and a third suction channel are positioned on opposite sides of the first suction channel and are parallel to the centreline plane (M), and a fourth suction channel and a fifth suction channel the first positioned to the side of the second suction channel and the second to the side of the third suction channel and are inclined in relation to the centreline plane (M).

8. The axial piston pump according to claim 1, in which the housing seats of the suction valves are aligned with each other along a same axis transversal to the central axes of the cylinders.

9. The axial piston pump according to claim 1, comprising a crankcase, inside which there is at least partially housed the inclined plate adapted to act on the pistons, and a plurality of through holes made in the head and adapted to receive the respective tightening screws configured to fix the head to the crankcase, and in which at least one of either a suction channel or a delivery channel crosses a portion of the head positioned between two adjacent through holes.

10. The axial piston pump according to claim 1, in which at least one of either of the plurality of delivery channels or the plurality of suction channels comprises a first stretch and a second stretch inclined in relation to each other.

* * * * *